US009873135B2

(12) United States Patent
Patti

(10) Patent No.: US 9,873,135 B2
(45) Date of Patent: Jan. 23, 2018

(54) METHOD AND APPARATUS FOR MULTI-COLOR PAINTING THERMOPLASTIC ARTICLES OF MANUFACTURE FOR PERFUMERY AND COSMETIC APPLICATIONS

(71) Applicant: MATIC PLAST MILANO S.R.L., Milan (IT)

(72) Inventor: Giovanni Patti, Milan (IT)

(73) Assignee: MATIC PLAST MILANO S.R.L., Milan (IT)

( * ) Notice: Subject to any disclaimer, the term of this patent is extended or adjusted under 35 U.S.C. 154(b) by 148 days.

(21) Appl. No.: 15/053,858

(22) Filed: Feb. 25, 2016

(65) Prior Publication Data

US 2017/0120291 A1 May 4, 2017

(30) Foreign Application Priority Data

Nov. 2, 2015 (IT) ..... 102015000068038

(51) Int. Cl.

| | |
|---|---|
| ***B05D 1/02*** | (2006.01) |
| ***B05B 12/14*** | (2006.01) |
| ***B05D 5/06*** | (2006.01) |
| ***B05D 7/02*** | (2006.01) |
| ***B05B 13/02*** | (2006.01) |
| *B05D 1/00* | (2006.01) |

(52) U.S. Cl.

CPC ..... *B05D 1/02* (2013.01); *B05B 12/1409* (2013.01); *B05B 12/1472* (2013.01); *B05B 13/0228* (2013.01); *B05D 5/06* (2013.01); *B05D 7/02* (2013.01); *B05D 1/002* (2013.01); *B05D 2254/06* (2013.01)

(58) Field of Classification Search

None

See application file for complete search history.

(56) References Cited

U.S. PATENT DOCUMENTS 3,553,371 A * 1/1971 Suenaga ..... H04N 1/034 358/501

2004/0005403 A1 1/2004 Nesbitt

FOREIGN PATENT DOCUMENTS

EP 0175235 A2 3/1986
EP 0970811 A1 1/2000

OTHER PUBLICATIONS

Italian Search Report in Serial No. ITUB20155011, the priority application corresponding U.S. Appl. No. 15/053,858, dated Jun. 20, 2016.

(Continued)

*Primary Examiner* — Michael P Rodriguez

(74) *Attorney, Agent, or Firm* — Hedman & Costigan, P.C.; James V. Costigan; Kathleen A. Costigan

(57) ABSTRACT

A method for painting with a plurality of colors at least an article of manufacture, preferably a thermoplastic article of manufacture for the perfumery and cosmetic field, each color of said plurality of colors being that of a respective paint of a corresponding plurality of paints, said method comprising at least the operating steps of: a) providing said at least an article of manufacture in a condition suitable for painting; b) providing a plurality of painting guns arranged in a succession in a painting tunnel and each being adapted to apply a paint of a said respective color of said plurality of colors; c) orienting said at least an article of manufacture with respect to said plurality of painting guns.

7 Claims, 3 Drawing Sheets

(56) References Cited

OTHER PUBLICATIONS

Written Opinion of Italian Patent Office in Serial No. ITUB20155011, the priority application corresponding to U.S. Appl. No. 15/053,858 issued partly in English.

* cited by examiner

METHOD AND APPARATUS FOR MULTI-COLOR PAINTING THERMOPLASTIC ARTICLES OF MANUFACTURE FOR PERFUMERY AND COSMETIC APPLICATIONS

BACKGROUND OF THE INVENTION

The present invention relates, according to a first aspect thereof, to a method for multi-color painting thermoplastic articles of manufacture, in particular in the perfumery and cosmetic field.

According to a second a second aspect thereof, the invention also relates to an apparatus for carrying out the inventive painting method.

As is known, a problem yet to be solved in the perfumery and cosmetic field is to make thermoplastic articles of manufacture which, besides having target constructional and functional properties, also have good aesthetic qualities, such as original and pleasing colors and hue arrangements, which frequently constitute a strong incentive for a consumer to buy a perfumery article.

Among the above mentioned colors and hue arrangements, the most preferred ones by clients are not only the so-called "continuous" hues, that is of a single color type, but also the so-called "shaded" colors, which are obtained, for example, by combining in an overlapping manner and "shading" more colors, that is by suitably emphasizing or enfeebling each color of the color pattern or combination.

Up to now, in order to paint in multiple colors an article of manufacture of the above indicated type, it has been necessary to perform a plurality of painting operations or steps, the number of which corresponding to the number of the colors of the paints to be applied, and accordingly to the number of the painting system settings.

Moreover, to paint as desired an article of manufacture, the latter was rotated in a continuous manner through 360°, while driving it according to a horizontal line through the overall painting system or apparatus, the painting guns being held at respective fixed positions to deliver a single paint at a time.

Thus, the prior painting process required a very long operating time, with a consequent low yield in finished painted articles of manufacture.

SUMMARY OF THE INVENTION

The aim of the present invention is to provide a novel painting method, in particular for painting the above mentioned articles of manufacture in the perfumery and cosmetic field, specifically designed for overcoming the above mentioned drawbacks of the prior painting method, that is the requirement of providing a plurality of different settings of the painting apparatus, equal to the number of the paints to be applied, thereby greatly reducing the multi-color painting time for each article of manufacture.

Within the scope of the above mentioned aim, a main object of the invention is to provide a painting method of the above indicated type, which allows to simultaneously paint, in a single operating step, a plurality of said articles of manufacture by applying substantially simultaneously to said articles a plurality of different color paints, within a broad range of target continuous or discrete colorings, that is on discrete regions of the article of manufacture, or shaded colors, that is according to any desired color overlapping pattern.

Another object of the present invention is to provide a painting method of the above mentioned type, whose operating steps may be easily controlled and adjusted in real time, in a very precise manner, while being controlled in real time by a programming logic unit of any commercially available type.

A further object of the present invention is to provide such a painting method of the above indicated type, which may be carried out without a need of performing substantial modifications of existing painting systems and apparatus.

Yet another object of the present invention is to provide such a painting apparatus for carrying out the inventive painting method, which apparatus is structurally very simple and operatively reliable, comprising a minimum number of operating components of an easily commercially available type, which moreover has a very small cost and furthermore does not require continuous adjusting and/or maintenance operations.

Yet another object of the present invention is to provide such a painting apparatus having a capability of painting said articles of manufacture which may be easily expanded to fit any industrial requirements related to painted articles of manufacture.

According to the present invention, the above mentioned aim and objects, as well as yet other objects, which will become more apparent hereinafter, are achieved by a painting method for painting, with a plurality of colors, at least an article of manufacture, preferably a thermoplastic article of manufacture for the perfumery and cosmetic field, according to the enclosed method claims.

According to a further aspect of the present invention, the above mentioned aim and objects are further achieved by a painting apparatus according to the apparatus claims, and specifically designed for carrying out the inventive painting method.

BRIEF DESCRIPTION OF THE DRAWINGS

Further characteristics and advantages of the painting method and apparatus according to the present invention will become more apparent hereinafter from the following detailed disclosure of a preferred embodiment thereof being shown, by way of an illustrative and not limitative example, in the accompanying schematic drawings, where.

DESCRIPTION OF THE PREFERRED EMBODIMENTS

Figure 1:
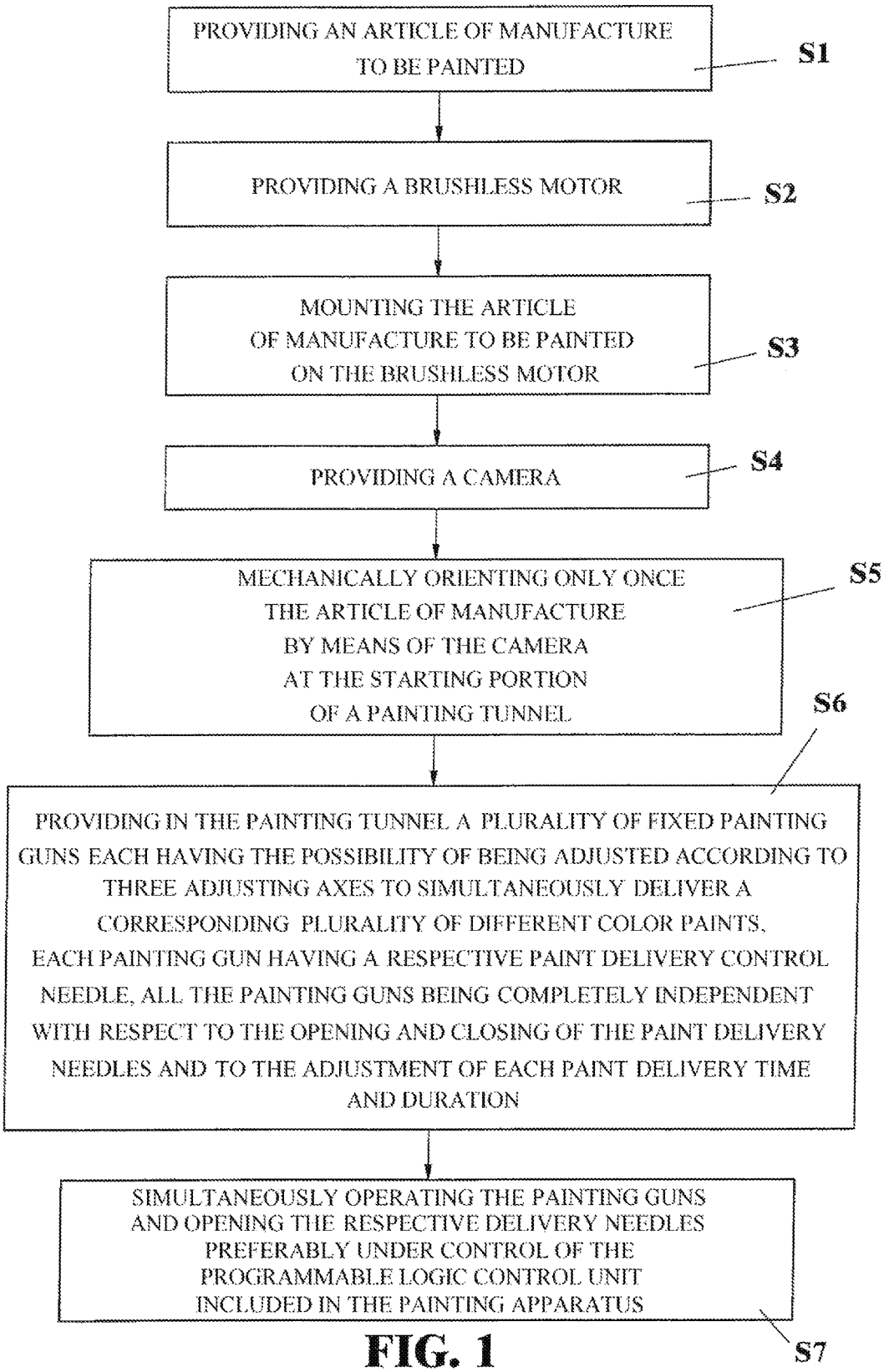
FIG. 1 is a block diagram showing the main operating step of a preferred embodiment of the painting method according to the present invention.

With reference to the above mentioned drawings, and more specifically to FIG. 1, a block diagram is shown of a preferred embodiment of the painting method according to the present invention.

As stated, up to now, in order to paint with a plurality of colors, for example five colors, an article of manufacture for the perfumery and cosmetic field, it has been necessary to perform, in the case of the mentioned five colors, five subsequent operating steps, that is one for each paint color, and accordingly with five corresponding settings and adjustments of the painting system.

In the above prior painting method, the article of manufacture to be painted was caused to turn on itself, in a continuous manner through 360°, and was simultaneously driven or displaced in a horizontal line through the painting system, while the paint delivery guns (shown in FIGS. 2 and 3) were held in a respective fixed position to deliver a single paint color at a time.

Thus, the above mentioned prior painting system was affected by the above disclosed serious drawbacks.

In the method according to the present invention, on the contrary, the articles of manufacture to be painted are rotatably driven by so-called brushless driving motors, of any known type, which, according to a further main feature of the present invention, are mechanically driven or oriented under control of a camera, while the several painting guns (in the embodiment being illustrated in a number of five), arranged in a suitable painting tunnel (not shown), are held at respective fixed positions to simultaneously deliver the five different color paints, either to a single article of manufacture or a plurality of articles, each supported by a dedicated brushless motor, all being driven in succession in front of the painting guns to be painted thereby as desired.

In this connection, it should be pointed out that the article of manufacture is advantageously oriented or adjusted only in a single adjustment step at the inlet of the painting gun tunnel, and then the adjustment of the rotary movement of the brushless motor (or of a plurality of brushless motors in the case of a plurality of articles of manufacture) will provide a desired orientation in front of each painting gun.

Again with reference to the flow chart of FIG. 1, in a method step S1, the article of manufacture to be painted is supplied or fed.

In a following operating step S2, a corresponding dedicated brushless motor is provided.

In a following operating step S3, the article of manufacture is removably mounted on the brushless motor, by any prior mounting or assembling means.

In a following operating step S4, a camera is provided for detecting the starting position of the brushless motor, with the article of manufacture mounted thereon (that is at the start portion of the mentioned painting gun tunnel), which camera is a further main feature of the inventive painting method.

In a following operating step S5, the article of manufacture is mechanically oriented by the brushless motor on which it has been removably mounted, under the control of the camera supplied in the operating step S4.

Then, in a following operating step S6, a plurality of painting guns are supplied (in this case five painting guns), at respective fixed operating positions, and advantageously each having the possibility of being adjusted according to three adjusting axes, to simultaneously deliver, according to the present invention, a corresponding plurality of different color paints (in this embodiment five color paints), each painting gun having a respective paint delivery control needle (not shown).

All the painting guns are advantageously completely independent of one another with respect to the opening and closing of the paint delivery needles thereof, as well as with respect to the adjustment of each paint delivery time and duration.

Finally, in a last operating step S7, the painting guns are simultaneously driven, by opening the respective needles, preferably under control of a programmable logic control unit (not shown) included in the painting apparatus.

Figure 2:
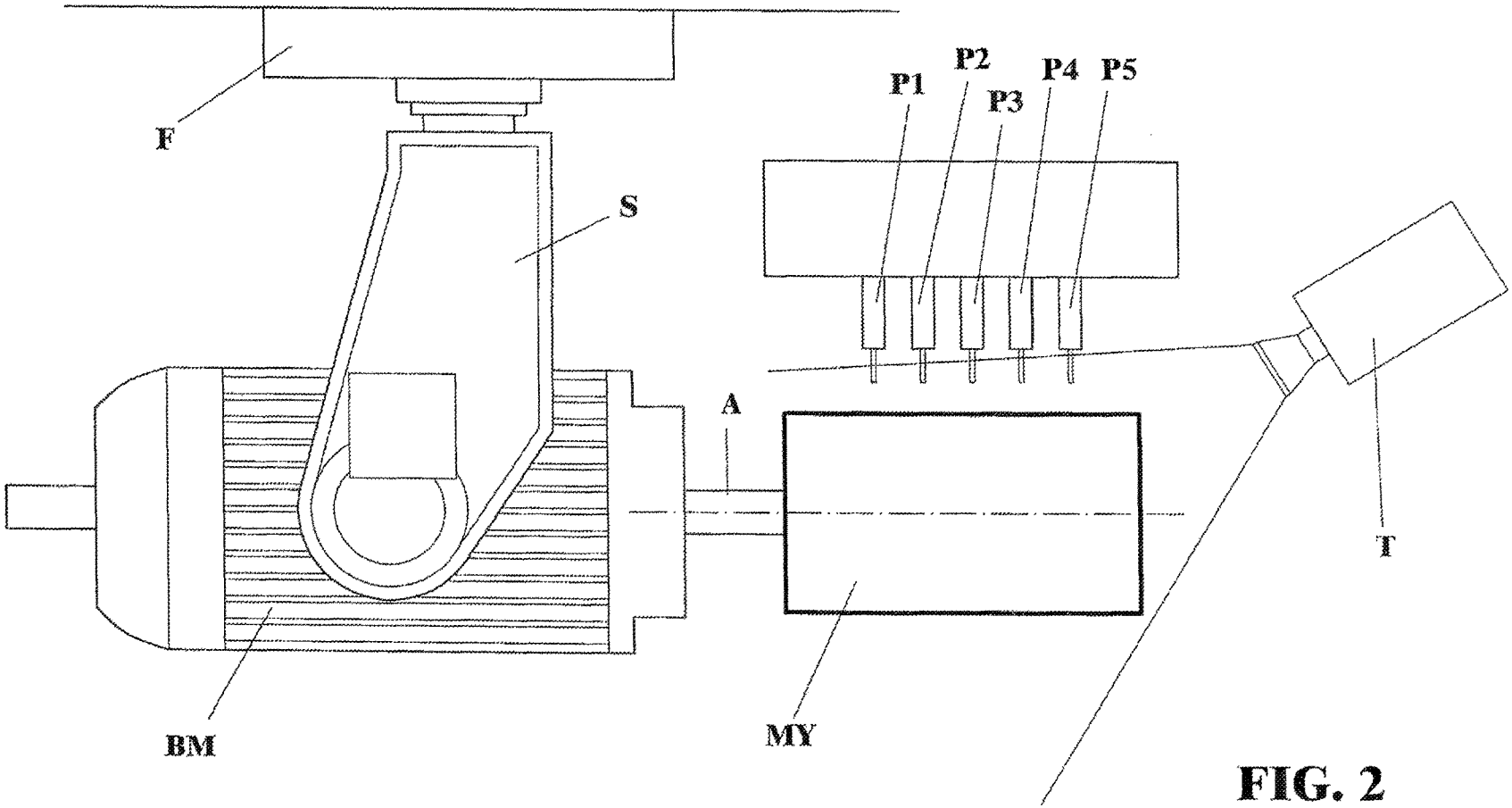
FIG. 2 is a schematic front view of a portion of a possible preferred embodiment of the painting apparatus according to the present invention.

The above mentioned method steps are carried out, with respect to a single article of manufacture MY to be painted, as schematically shown in FIG. 2.

In this connection, it should be pointed out that, even though in FIG. 2 has been shown a single article of manufacture to be painted, removably mounted on a dedicated brushless motor BM, in actual practice, in a preferred embodiment of the apparatus according to the present invention, a plurality of articles of manufacture to be painted will be provided, each being removably mounted on a respective dedicated brushless motor BM.

As further shown in FIG. 2, the brushless motor BM is supported by a supporting assembly S fixed, for example in an adjustable manner, to the fixed framework of the painting apparatus (not shown).

Figure 3:
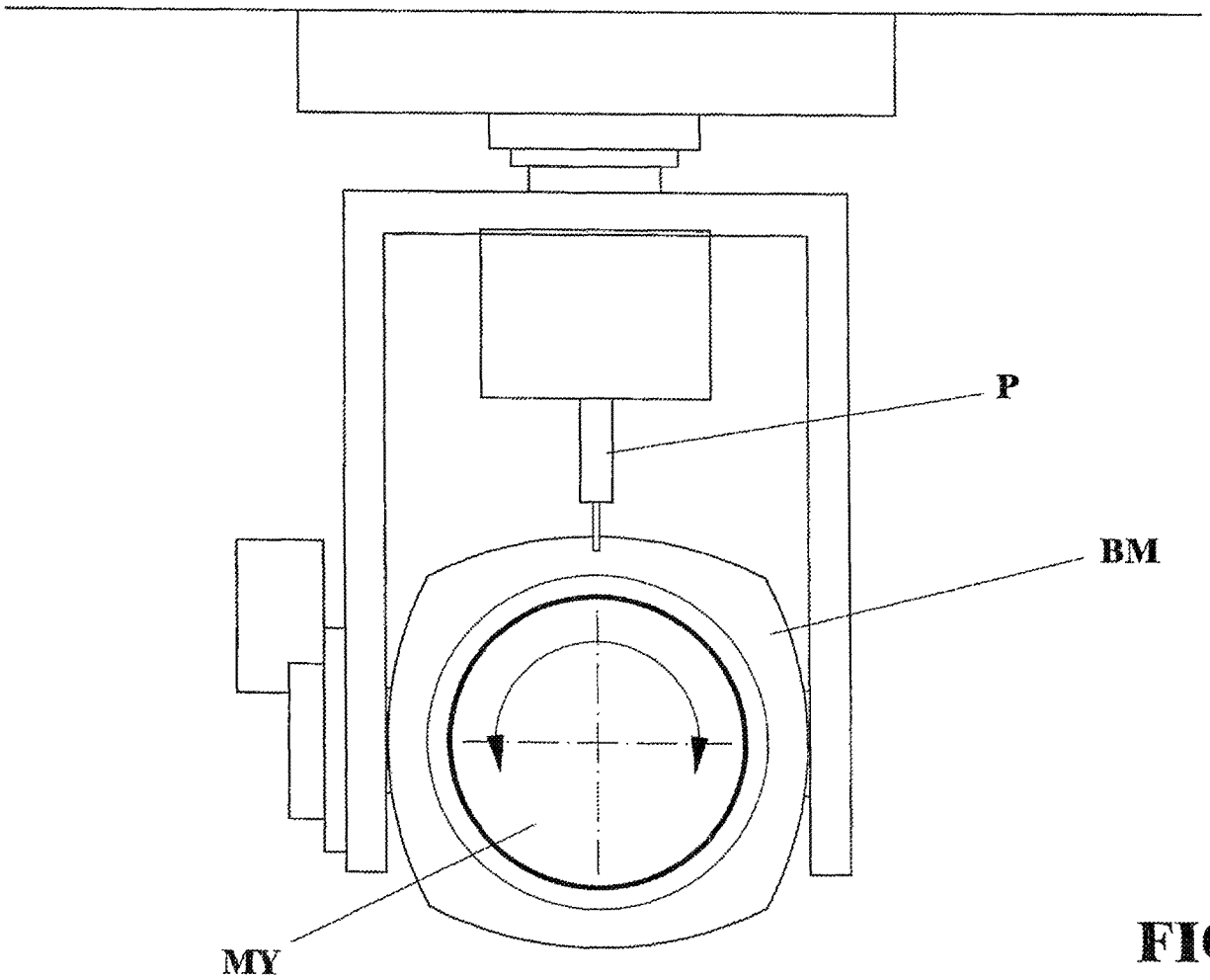
FIG. 3 is a schematic side view of the apparatus portion shown in FIG. 2.

The painting apparatus of FIGS. 2 and 3 comprises, moreover, a plurality of paint delivery guns, arranged at respective fixed positions and indicated, for example, for the five color embodiment herein discussed, by the reference signs P1, P2, P3, P4, P5 and shown in a mutually aligned condition properly arranged through the above mentioned painting tunnel (not shown).

Advantageously, each said painting gun may be spatially adjusted according to the three spatial axes x, y and z (not shown).

Said painting guns P1, P2, P3, P4, P5 include, as stated, respective paint control needles (not shown), said painting guns being advantageously completely independent of one another with respect to the opening and closing of their paint delivery needles, as well as with respect to the delivery time and duration.

This feature also represents a main aspect of the present invention.

Finally, and according to a further main inventive characteristic, the apparatus further comprises a camera T allowing the article of manufacture MY, or preferably a plurality of articles of manufacture, each driven or rotated on a respective brushless motor, to be mechanically oriented only for a single time, since said camera T will detect in real time the positions or arrangements of said articles of manufacture at the inlet of the painting gun tunnel, as said above.

Advantageously, said camera T is adapted to drive in an oriented manner each said article of manufacture MY at the inlet of the painting apparatus, for example by a background plane divided into millimeters (not shown) adapted to allow said camera to detect in real time the starting position of each said article of manufacture, to process, in cooperation with a programmable logic control unit (not shown), the rotary movement of the motor BM necessary to bring the article of manufacture MY to the desired position in front of the painting guns, the opening and closing movements of the respective gun needles (not shown) being advantageously controlled by that same programmable logic control unit (PLC) as the latter is enabled by the motor BM having performed the desired rotary movement.

Thus, according to the present invention, said articles of manufacture MY are rotatably driven by said brushless motors BM which are mechanically oriented under the control of the mentioned camera, while the painting guns are held at fixed positions to simultaneously deliver their different color paints.

Accordingly, the painting operation, which may be either discrete or shaded (that it with partially overlapping colors), may be performed in a very short time, and the articles of manufacture to be painted may be precisely controlled in a single adjusting operation.

Although the inventive method and apparatus have been disclosed with reference to a currently preferred embodiment thereof, it should be apparent that the disclosed embodiment is susceptible to several modifications and variations, all of which will come within the scope of the invention.

For example, although the painting method and apparatus have been disclosed with reference to a painting in five colors of an article of manufacture, it should be apparent that the number of colors may be easily changed in a very broad color range, depending on the contingent requirements.

The invention claimed is:

1. A method for painting with a plurality of colors a thermoplastic article of manufacture for the perfumery and cosmetic field, each color of said plurality of colors being that of a respective paint of a corresponding plurality of paints, said method comprising at last the operating steps of:

a) providing said article of manufacture in a condition suitable for painting;

b) providing a plurality of painting guns arranged in a succession in a painting tunnel and each being adapted to apply a paint of a said respective color of said plurality of colors; and c) orienting said article of manufacture with respect to said plurality of painting guns;

characterized in that said method further comprises the steps of:

d) acquiring in real time an image of said article of manufacture;

e) orienting, based on said acquired image, said article of manufacture with respect to said plurality of painting guns; and f) driving said plurality of painting guns to cause said painting guns to simultaneously deliver, on said oriented article of manufacture, at least some or all of said colors of said plurality of colors to provide a desired coloring of said article of manufacture.

2. A method, according to claim 1, characterized in that said article of manufacture is oriented in said step c) by a respective brushless motor with which said article of manufacture is removably associated, said brushless motor being so driven as to be operatively caused to slide in front of said painting guns to perform a preset angular rotary movement thereby causing said article of manufacture associated therewith to correspondingly turn in order to assume a preset operating painting position with respect to said plurality of painting guns.

3. A method, according to claim 2, characterized in that said image of said article of manufacture is acquired in real time by a camera cooperating with indicating means for indicating in real time a spatial position of said brushless motor and said article of manufacture supported thereby, said indicating means allowing said camera to detect and evaluate in real time a position of said article of manufacture at a starting portion of said painting tunnel, to drive said motor for bringing said article of manufacture to a preset position with respect to said plurality of painting guns.

4. A method, according to claim 1, characterized in that said paints are applied to said article of manufacture so as to define on said article of manufacture preset discrete and/or shaded colored regions of preset different colors.

5. A method, according to claim 1, characterized in that said painting guns are adapted to be oriented with a possibility of three-axis adjustment.

6. A method, according to claim 3, characterized in that said indicating means for indicating in real time a position of said article of manufacture comprise a background plane divided into millimeters allowing said camera to detect a position of said article of manufacture at said painting tunnel starting portion and to bring said article of manufacture to said preset position with respect to said painting guns.

7. A method, according to claim 1, characterized in that each said painting gun comprises a respective paint delivery control needle element for controlling a delivery of a respective said paint, all said needle elements being operatively displaceable independently of one another in a timed manner between respective closing and opening positions.

* * * * *